United States Patent [19]

Nishikawa

[11] 3,974,974

[45] Aug. 17, 1976

[54] BACK TENSION IMPARTING DEVICE

[75] Inventor: Tatsuo Nishikawa, Tokyo, Japan

[73] Assignee: Ricoh Co., Ltd., Tokyo, Japan

[22] Filed: May 8, 1974

[21] Appl. No.: 468,075

[30] Foreign Application Priority Data

May 15, 1973 Japan ..... 48-57196[U]

[52] U.S. Cl. ..... 242/55; 242/67.3 R; 242/75.4; 355/16

[51] Int. Cl.[2] ..... B65H 17/04; B65H 23/06

[58] Field of Search ..... 242/55, 67.3, 75.4, 242/156, 156.2, 129.3, 75; 355/16

[56] References Cited

UNITED STATES PATENTS

| | | | |
|---|---|---|---|
| 1,688,444 | 10/1928 | Wheelbarger | 242/75.4 |
| 1,953,869 | 4/1934 | Sadgebury | 242/75.4 |
| 1,969,877 | 8/1934 | Doty | 242/75.4 X |
| 2,139,784 | 12/1938 | Wengel | 242/75.4 X |
| 2,789,776 | 4/1957 | Begun et al. | 242/67.3 R X |
| 3,130,931 | 4/1964 | Hautly | 242/67.3 R X |
| 3,405,791 | 10/1968 | Kaplan | 242/75.4 X |
| 3,411,285 | 11/1968 | McDonald | 242/156 X |
| 3,480,361 | 11/1969 | Tatsumi Doi et al. | 355/16 |
| 3,588,242 | 6/1971 | Berlier | 242/55 X |
| 3,826,570 | 7/1974 | Kolibas | 355/16 X |

*Primary Examiner*—Stanley N. Gilreath
*Assistant Examiner*—John M. Jillions
*Attorney, Agent, or Firm*—Cooper, Dunham, Clark, Griffin & Moran

[57] ABSTRACT

A device for imparting back tension of a predetermined magnitude to the portion of strip material disposed between a take-up reel and a supply reel when the strip material wound at one end on the supply reel and at the other end on the take-up reel is paid out of the supply reel by rotating the take-up reel. The device has particular utility in an electrophotographic copying apparatus employing a photosensitive drum in which a strip of photoconductive film is interchangeably mounted and comprises a novel mechanism, light in weight and low in cost, which has the effect of imparting to the strip back tension which it is required to have when in use and yet enabling the strip to be advanced and wound on the take-up reel with the exercise of a force slightly in excess of the back tension present in the strip.

7 Claims, 2 Drawing Figures

BACK TENSION IMPARTING DEVICE

BACKGROUND OF THE INVENTION

This invention relates to back tension imparting devices, and more particularly it is concerned with a device for imparting back tension to a strip of photoconductive film wound on a photosensitive drum for an electrophotographic copying apparatus.

In an electrophotographic copying apparatus of the transfer printing type, an intermediate image is formed on a photoreceptor from an electrostatic latent image of an original to be copied or a toner image obtained by causing toner particles to adhere to the electrostatic latent image and is then, duplicated by transfer printing on a sheet of ordinary paper and developed or fixed so as to produce a copy of the original.

In one type of apparatus, such photoreceptor may be deposited by vacuum vaporization of zinc oxide on the outer peripheral surface of a drum. This type of photoreceptor has the disadvantage of being expensive and it is troublesome to replace the old photoreceptor by a new one when the former deteriorates after repeated use for production of copies. In order to obviate these disadvantages proposals have been made to use a photoreceptor in flexible film form which is wound on the outer peripheral surface of a drum and affixed at opposite ends to a supply reel and a take-up reel mounted in the interior of the drum. When it is desired to replace the portion of the photosensitive film on the outer peripheral surface of the drum by another portion, the photosensitive film can be paid out of the supply reed by rotating the take-up reel and thus the old portion of the photosensitive film serving as a photoreceptor can be replaced by a new portion with ease.

It is necessary to impart back tension of a predetermined magnitude to the photosensitive film wound on the other peripheral surface of the drum in order that the film may be maintained in intimate contact with the drum since the film may become loose as one portion is replaced by a new portion thereof by rotating the take-up reel or when copying is performed repeatedly. When loosening of the photosensitive film occurs, many troubles will occur as presently to be described. In the charging station, the distance between the charging electrode and the photosensitive film or photoreceptor on the drum will become non-uniform and thus uneven charging of the photorecptor or destruction thereof by charging will result. In the developing station, the distance between the opposite electrode and the photoreceptor will become non-uniform and thus it will become impossible to produce copies with developed images of uniform quality, and the contact of the photoreceptor with the opposite electrode will cause a leak of the bias potential and soiling of the background of the image. If the toner particles find their way to the underside of the photoreceptor and adhere to the outer peripheral surface of the drum, the photoreceptor will become irregular in surface and tend to be damaged in the cleaning operation. Besides, there will be a decline in the resolving power of the photoreceptor. When a developing agent of the wet type is employed, some of the developing liquid will find its way to the underside of the photoreceptor. Such liquid will move about on the outer peripheral surface of the drum when pressure is applied to the photoreceptor by the cleaning or transfer-printing roller, and will finally be scattered transversely in the passageway of the photoreceptor in and out of the drum or introduced into the interior of the drum.

In an effort to prevent loosening of the portion of the photosensitive film serving as a photoreceptor on the outer peripheral surface of the drum, proposals have been made to apply a brake to the supply reel from which the photosensitive film is paid out. This has, however, had no effect of preventing loosening of the photosensitive film and the aforementioned troubles have therefore been experienced. Also, the use of a floating roller to prevent the loosening of the photosensitive film has been proposed. This has the following disadvantages. The floating roller needs a brake to form a combination therewith and thus the mechanism becomes complex in construction and takes more space than is necessary. Adjustments of the mechanism are troublesome because the brake should be applied to the supply reel with a force which is higher than the drive force exerted by the floating roller and lower than the force with which winding of the film is effected by the take-up roller. When the brake force is set at a level such as to ensure that the supply reel is not rotated by the floating roller, the brake force is considerably high and the torque required for advancing and winding the film on the take-up reel becomes high, thereby increasing possibilities of damage to the film serving as a photoreceptor and increasing the magnitude of the load applied to each part of the apparatus.

SUMMARY OF THE INVENTION

This invention provides a back tension imparting device obviating the aforementioned disadvantages of the prior art which has the effect of normally tensioning strip material with a required force and thereby preventing loosening of the strip material which would otherwise occur, and which does not interfere with the feeding of the strip material but permits the strip material to be advanced under the back tension by a force slightly greater than the required force when it is required to replace the old portion of the strip material by a new portion.

According to the invention, there is provided a back tension imparting device comprising a take-up reel on which strip material is wound at one end thereof, means for preventing rotation of the take-up reel in a direction in which the strip material wound thereon recoils, means for driving the take-up reel to rotate in a direction in which the strip material is advanced and wound on the take-up reel, a supply reel on which the strip material is wound at the other end thereof, means for urging, through releasable rotation clutch means, the supply reel to rotate in a direction in which back tension is imparted to the strip material and means for permitting the strip material to be advance against the back tension by a force slightly in excess thereof.

DESCRIPTION OF A PREFERRED EMBODIMENT OF THE INVENTION

Figure 1:
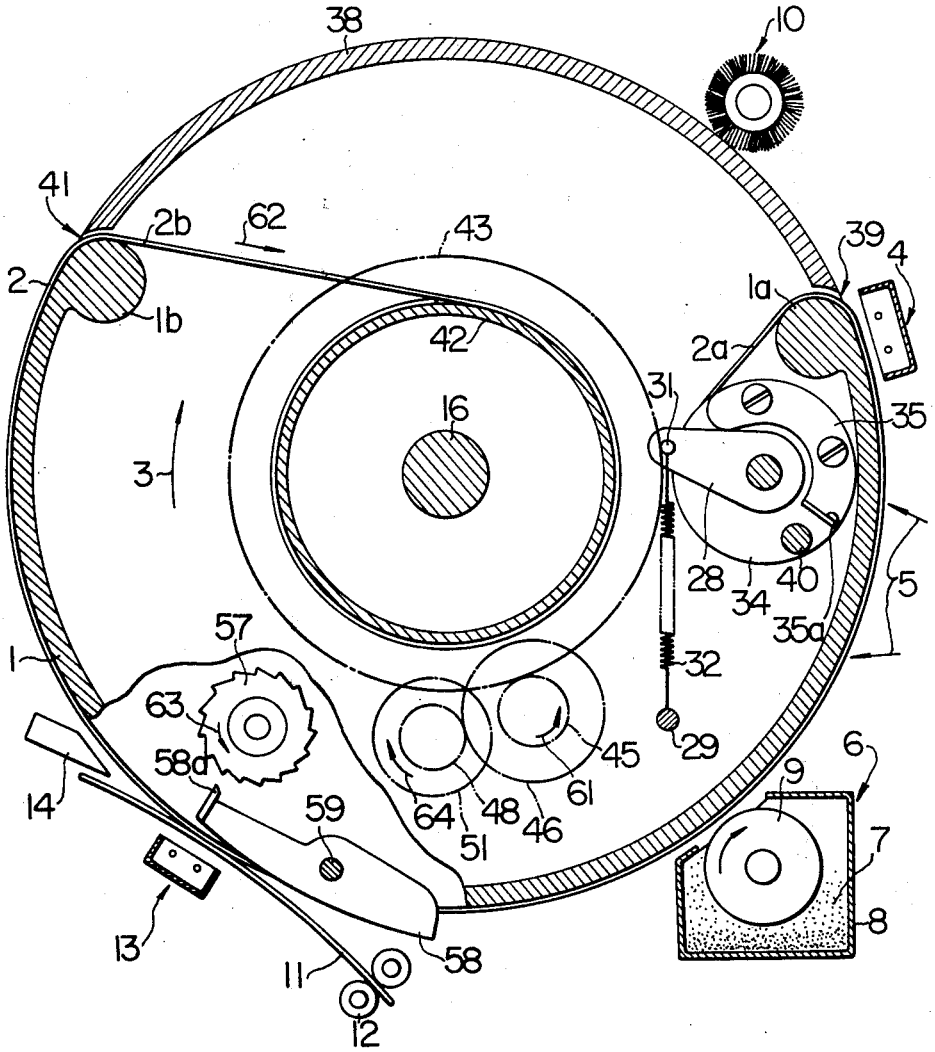
FIG. 1 is a transverse sectional view of a photosensitive drum of a electrophotographic copying apparatus incorporating therein the principles of the invention.

In FIG. 1, a film 2 functioning as a photoreceptor of the photoconductive type is wound on the outer peripheral surface of a photosensitive drum 1. The film 2 which is about 0.1 millimiter thick comprises a base which may be made of polyester or other synthetic resinous material, an aluminum or other electrically conductive material layer formed on the base, and a layer of polyvinyl carbazol or other optical organic semiconductor deposited by vacuum vaporization on the electrically conductive material layer.

The drum 1 is driven to rotate in the direction of an arrow 3, and the portion of the film 2 wound on the outer peripheral surface of the drum 1 is first charged uniformly by a charging device 4 and then exposed to an optical image 5 of an original (not shown), so that an electrostatic latent image is formed on the film 2. Toner particles are supplied to the electrostatic latent image by a developing device 6 comprising a case 8 containing toner particles 7 therein, and a roller 9 adapted to be rotated in the direction of an indicated arrow to bring the toner particles 7 into contact with the film 2. Thus, the toner particles 7 adhere to the electrostatic latent image to develop the same into a visible image.

A sheet 11 for producing a copy is delivered by a pair of delivery rollers 12, 12 and directed to the outer peripheral surface of the drum 1, and the toner image obtained by developing is printed by transfer printing on the surface of the sheet 11 by means of a transfer-printing charger 13. The sheet 11 on which the toner image has been printed by transfer printing is stripped from the drum 1 by stripper means 14. Then, the image on the sheet 11 is fixed by a fixing device (not shown). The toner particles remaining on the film 2 after the transfer-printing operation has been performed are removed by a cleaner 10 which performs the operation of cleaning the film 2.

Figure 2:
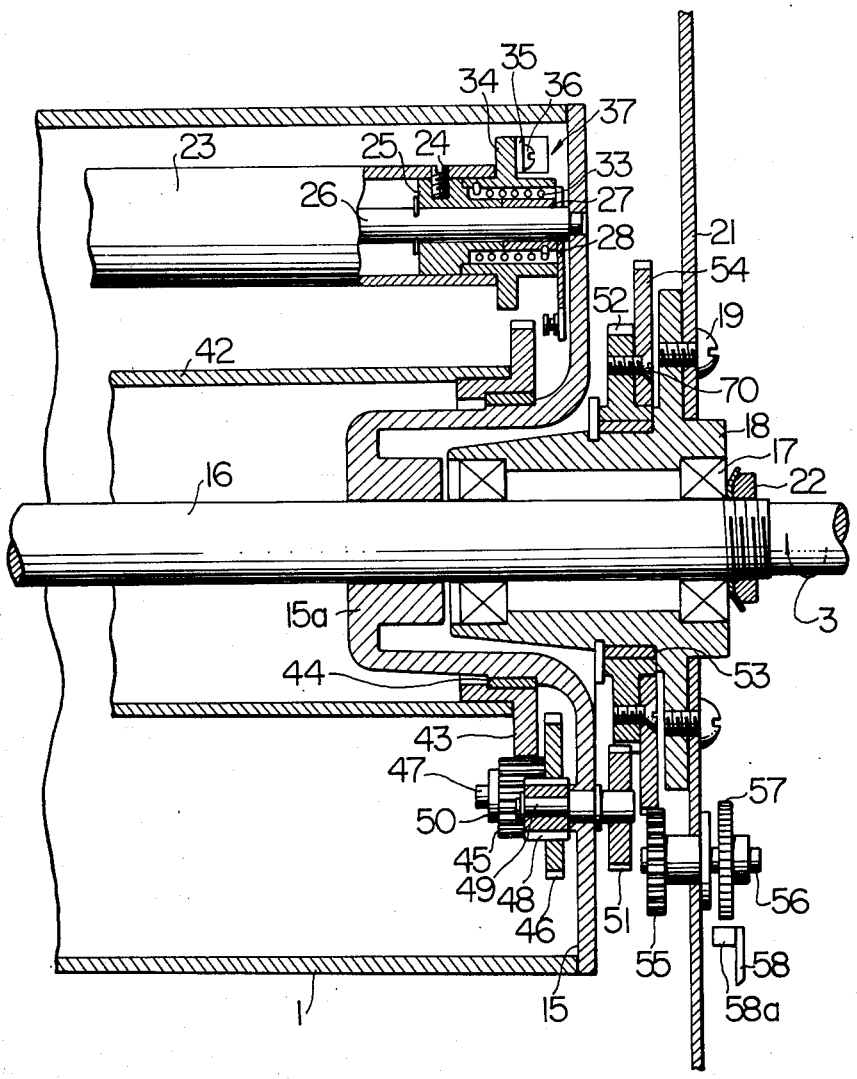
FIG. 2 is a fragmentary longitudinal sectional view of the photosensitive drum shown in FIG. 1.

In FIG. 2, a boss 15*a* of an end wall 15 of the drum 1 is affixed to a shaft 16 which is journalled by a bearing 17 housed in a bearing box 18 mounted on a immovable side plate 21 of the apparatus by screws 19. The shaft 16, which is kept from moving axially by a nut 22, is driven by a drive (not shown) to rotate in the direction of the arrow 3 or clockwise in FIG. 2 as seen from right to left. One end 2*a* of the film 2 (See FIG. 1) is affixed to and wound on a supply reel 23 mounted in the interior of the drum 1 and disposed parallel to the axis thereof. The supply reel 23 is secured by a screw 24 to a tubular shaft 25 which is rotatably mounted on a shaft 26 mounted on the two opposite end walls 15 (only one is shown) of the drum 1.

The shaft 26 has loosely mounted at one end thereof a tubular shaft 27. A tensioning member 28 is secured at its base to an end portion of the tubular shaft 27 and urged to move counter clockwise in FIG. 1 by the biasing force of a tension spring 32 connected at one end to an immovable pin 29 (See FIG. 1) and at the other end to a pin 31 affixed to the free end of the member 28.

In FIG. 2, a coil spring 33 is tightly mounted on the peripheries of the two tubular shafts 25 and 27 and connected at one end to a release member 34 and at the other end to the tubular shaft 27. The spring 33 is coiled such that it tends to tighten on the shafts 25 and 27 the more shaft 27 rotates in the direction in which back tension is imparted to the film 2, as shown in FIG. 2. The release member 34, which is rotatably mounted at one end portion of the supply reel 23, surrounds the spring 33 and includes a flange to which a stopper 35 is connected by screws 36. The stopper 35 includes a bent portion 35a which, as shown in FIG. 1, is juxtaposed to a pin 40 affixed to the end wall 15. The tubular shafts 25 and 27, spring 33 and release member 34 constitute spring clutch means generally designated 37. When clutch means 37 is engaged back tension is imparted to the film 2 and also when it is disengaged when a force slightly in excess of the back tension is imparted to the film 2 to pay it out of the supply reel 23 as subsequently to be described.

In FIG. 1, the outer peripheral surface of the drum 1 has a cutout which is closed by a cover 38 of a circularly arcuate shape. The cover 38 is spaced, at opposite straight ends, apart from respective ends 1*a* and 1*b* of the remaining arcuate wall of the drum 1 by a film supply port 39 and a film introducing port 41. The film 2 is affixed to and wound on a take-up reel 42 at the opposite end 2b thereof. The take-up reel 42 is arranged to be concentric with the drum 1 as shown in FIG. 1 and has secured to one end thereof a gear 43 which is rotatably supported by the boss 15*a* of the end plate 15 through a bearing 44.

A pinion 45 maintained in meshing engagement with the gear 43 and a gear 46 which is integral with the pinion 45 are mounted through a one-way rotation clutch 50 on a shaft 47 affixed to the end plate 15 of the drum 1. In virtue of the one-way rotation clutch 50, the pinion 45 and gear 46 can rotate counter clockwise (in the direction of an arrow 61 in FIG. 1) in FIG. 2 as seen from right to left but are kept from rotating in the opposite direction. In other words, the take-up reel 42 is permitted to rotate in the direction of the arrow 3 in FIG. 1 but kept from rotating in the opposite direction by the one-way rotation clutch 50. Thus, rotation of the take-up reel 42 in a direction opposite to the direction of the arrow 3 which would otherwise be caused by the tension of the film 2 can be precluded.

A pinion 48 maintained in meshing engagement with the gear 46 is affixed to a shaft 49 rotatably supported by the end wall 15 and including an end portion extending outwardly of the end wall 15 and supporting a gear 51 thereon. Maintained in meshing engagement with gear 51 is a sun gear 52 which is supported by a bearing box 18 through a bearing 53. Maintained in meshing engagement with a gear 54 connected to the sun gear 52 through screws 70 is a pinion 55 mounted on a shaft 56 rotatably supported by the side plate 21. A ratchet wheel 57 is mounted at an end of the shaft 56 opposite the end at which the pinion 55 is mounted with respect to the side plate 21, and a pawl 58*a* of a stopper 58 is juxtaposed to the periphery of the ratchet wheel 57. In FIG. 1, the stopper 58 is shown an being pivotally supported by a shaft 59 affixed to the end wall 21, and the pawl 58*a* is normally spaced apart from the ratchet wheel 57.

The tensioning member 28 is urged to move counter clockwise in FIG. 1 by the biasing force of the spring 32. The movement of the member 28 is transmitted to the supply reel 23 through the spring clutch means 37 (See FIG. 2), so that the reel 23 is urged to rotate counter clockwise in FIG. 1. The film 2 is tensioned by the tendency of the supply reel 23 to rotate in this direction. Since the take-up reel 42 is kept from rotating in a direction opposite to the direction of the arrow 3 by the action of the one-way rotation clutch 50 as aforementioned, the reel 42 is supported as if it were fixed with respect to the end wall 15 of the drum 1. Hence the back tension on the film 2 corresponds to the biasing force of spring 32 when take-up reel 42 is kept from rotating.

Thus, if the drum 1 rotates in the direction of the arrow 3, the take-up reel 42 will rotate in the same direction with the drum 1 as a unit. That is, the gear 43 secured to the take-up reel 42 (See FIG. 2) remains stationary with respect to the end plate 15 of the drum 1 when the drum 1 rotates, so that the pinion 45 and gear 46 mounted on the end wall 15 do not rotate on their own axes and merely revolve around the shaft 16 together with the drum 1. Furthermore, the pinion 48 which is in meshing engagement with the gear 46, and the gear 51 which is mounted on the same shaft 49 as the pinion 48, merely revolve around the shaft 16 without rotating on their own axes. Thus, the gears 52 and 54 supported by the bearing box 18 rotate in the same direction as the drum 1 as the latter rotates. Rotation of gear 54 causes the pinion 55 and ratchet wheel 57 to rotate idly in the direction of an arrow 63 in FIG. 1.

The mode of operation of the device according to the invention in replacing the portion of the film 2, wound on the outer peripheral surface of the drum 1 and serving as a photoreceptor, by a new portion of the film 2 will now be described. First, the stopper 58 is moved clockwise in pivotal movement in FIG. 1 so as to bring the pawl 58*a* into engagement with a tooth of the ratchet wheel 57. The stopper 58 restrains the ratchet wheel 57 and precludes its rotation for a short time interval while the drum 1 rotates. As the ratchet wheel 57 remains stationary, the sun gear 52 also is held stationary because its rotation is precluded through pinion 55 and gear 54.

On the other hand, the gears 51, 48 and 46, 45 can rotate only in the directions of arrows 64 and 61 respectively in FIG. 1 in virtue of the action of the one-way rotation clutch 50. Thus, when the sun gear 52 remains stationary, gear 51 revolves around the sun gear 52 in the indicated direction in FIG. 1. That is, gear 51 and pinion 48 revolve around the shaft 16 while rotating on their own axes, and their rotation on their own axes is transmitted to gear 43 through gear 46 and pinion 45. As a result, the take-up shaft 42 rotates in the direction of the arrow 3 relative to the rotating drum 1 as shown in FIG. 1, thereby advancing and winding the film 3 thereon.

As the film is advanced in the direction of an arrow 62 in FIG. 1 and wound on the take-up reel 42, the supply reel 23 rotates clockwise in FIG. 2 as seen from right to left against the biasing force of the spring 32 transmitted thereto through the spring clutch means 37 and tensioning member 28. The biasing force of the spring 32 acts on the supply reel 23 while the latter rotates. Rotation of the supply reel 23 causes the release member 34 to rotate in the same direction, and the bent portion 35a of the stopper 35 connected to the release member 34 is brought into abutting engagement with the immovable pin 40 (See FIG. 1), thereby preventing further rotation of the release member 34. The stopping of member 34 causes the spring 33 to slightly loosen so that the spring clutch 37 is disengaged, that is, the shaft 25 is permitted to rotate relative to spring 33 against the frictional force therebetween. Then, the supply reel 23 and the tubular shaft 25 can rotate together only against this frictional force which substantially corresponds to the action of the spring 32 at this stage (See FIG. 1). Thus, the film 2 is paid out and a new portion thereof is wound on the peripheral surface of the drum 1 to serve as a photoreceptor.

This completes the replacement of the old portion of the film 2 which has deteriorated by the new portion thereof. When the film 2 is advanced and wound on the take-up reel 42, the pawl 58a of the stopper 58 must be released from engagement with the ratchet wheel 57. The stopper 58 can be released by manual operation or by the action of a solenoid (not shown). As aforementioned, the take-up reel 42 and gear 43 are driven to rotate in the direction of the arrow 3 because the sun gear 52 remains stationary and the pinion 51 revolves around the sun gear 52 as a planet gear when the old portion of the film 2 on the outer peripheral surface of the drum 1 is replaced by a new portion thereof. However, upon the sun gear 52 being thus released from restraint, the drive force of the pinion 51 is not transmitted to the take-up reel 42. As a result, the supply reel 23 which is driven to rotate by the drive force acting on the advancing film 2 stops rotating, so that the release member 34 is deprived of the force exerted on the stopper 35 to bring the same into pressing engagement with the pin 40 (See FIG. 1). Then, release member 34 is rotated in the direction in which back tension is imparted under the action of spring 33 which tightens on shafts 25 and 27 under the action of spring 32 on the latter, and, thus,1 the spring clutch 37 is engaged again.

Accordingly, a torque tending to recoil the film 2 wound on the supply reel 23 is applied to the supply reel 23 by the biasing force of the spring 32 acting on the tensioning member 28 when rotation of the supply reel is interrupted, so that back tension is imparted to the film. Rotation of the take-up reel 42 which would otherwise be caused by the back tension imparted to the film 2 is precluded by the action of the one-way clutch 50 mounted between pinion 45 and shaft 37 as aforementioned.

Thus, according to the invention, a torque normally applied to the supply reel 23 and acting as back tension imparted to the film 2 is maintained approximately the same even when the old portion of the film 2 on the outer peripheral surface of the drum 1 is replaced by a new portion thereof, so that the film 2 can be smoothly paid out of the supply reel 23. Upon completion of the paying out of the film 2, the spring clutch means is engaged again and a predetermined amount of back tension is automatically imparted to the film 2, thereby eliminating the troubles which would otherwise be caused by the loosening of the film as aforementioned.

What is claimed is:

1. A back tension imparting device for use in winding strip material comprising:

a. a take-up reel on which one end of said strip material is wound;

b. means for preventing rotation of said take-up reel in the direction in which the strip material wound thereon recoils;

c. means producing a driving force for driving the take-up reel to rotate in the direction in which the strip material is advanced and wound on the take-up reel;

d. a supply reel on which the other end of the strip material is wound and comprising a first rotatable shaft; and e. means for urging the supply reel to rotate in a direction in which back tension is imparted to the strip material, said urging means comprising:

i. a second rotatable shaft disposed in alignment with said first rotatable shaft;

ii. means for connecting said first and second shafts for rotation as a unit, comprising a coil spring surrounding and tightly engaging said first and second shafts and having one end connected to said second shaft;

iii. means for applying a back tension force to said second shaft to urge it to rotate in a direction in which back tension is imparted to the strip material; and iv. means connected to the other end of said coil spring for loosening said coil spring when the driving force on said strip material from said driving means exceeds the back tension force on said second shaft to permit rotation of said first shaft with respect to said second shaft and against the frictional force applied by said coil spring.

2. A device as in claim 1 further comprising a rotatable drum having a cutout in its periphery, on which periphery said strip material is wound, and said take-up reel and said supply reel being housed in the interior of the rotatable drum.

3. A device as in claim 2 wherein said means for driving the take-up reel comprises a gear train means for operatively connecting said rotatable drum to said take-up reel to cause said strip material to be wound on the take-up reel as said rotatable drum rotates, and means for connecting and disconnecting said rotatable drum to said take-up reel through said gear train.

4. A device as in claim 1 wherein the means for driving said take-up reel comprises:

a drum member coaxially disposed about said take-up reel and on which said take-up reel is mounted for rotation;

means for supporting said drum member in rotation;

means for rotating said drum member in one direction on said support means;

first and second gear means, rotatably mounted on said support means, for engaging and cooperatingly rotating with each other, said second gear means including a sun gear;

third gear means, mounted on said drum member, for rotation therewith and including a planetary gear for cooperatively engaging said sun gear;

fourth gear means, mounted on said drum member for rotation therewith, for engaging and cooperatingly rotating with said third gear means;

fifth gear means, mounted on and rotatable with said take-up reel, for engaging and cooperatingly rotating with said fourth gear means; and means for holding said first gear means against rotation.

5. A device as in claim 4 wherein the means for preventing rotation of said take-up reel in the direction in which the strip material wound thereon recoils comprises one-way rotation clutch means upon said drum member for supporting said fourth gear means for rotation thereon.

6. A device as in claim 1 wherein said means for applying a back tension force comprises:

an arm connected to said second rotatable shaft; and a tension spring connected to said arm.

7. A device as in claim 1 wherein said loosening means comprises: a rotatable release means surrounding said coil spring and fixed to said other end thereof for rotation therewith; and stop means for stopping said release means from further rotation with said coil spring after rotation through a predetermined angle in a direction in which the strip material is advanced.

* * * * *